US006238309B1

(12) United States Patent
Sample

(10) Patent No.: US 6,238,309 B1
(45) Date of Patent: May 29, 2001

(54) BREAK RESISTANT BALL BAT

(76) Inventor: Joe M. Sample, 16615 Mt Spokane, Mead, WA (US) 99021

( * ) Notice: Subject to any disclaimer, the term of this patent is extended or adjusted under 35 U.S.C. 154(b) by 0 days.

(21) Appl. No.: 09/357,119

(22) Filed: Jul. 19, 1999

(51) Int. Cl.[7] ..... A63B 59/06
(52) U.S. Cl. ..... 473/564; 473/567
(58) Field of Search ..... 473/564, 567, 473/568; 264/221

(56) References Cited

U.S. PATENT DOCUMENTS

| | | | | |
|---|---|---|---|---|
| 310,248 | | 1/1885 | Brown . | |
| 780,244 | | 1/1905 | Truesdell . | |
| 1,063,563 | | 6/1913 | May . | |
| 1,450,646 | | 4/1923 | Sadenwater . | |
| 1,706,680 | | 3/1929 | Smith . | |
| 3,129,003 | * | 4/1964 | Mueller et al. | 473/568 |
| 4,331,330 | | 5/1982 | Worst | 273/72 R |
| 4,714,251 | | 12/1987 | Cook | 273/72 R |
| 4,848,745 | * | 7/1989 | Bohannan et al. | 473/567 |
| 5,284,332 | | 2/1994 | DiTullio | 273/72 R |
| 5,460,369 | | 10/1995 | Baum | 273/72 R |
| 5,490,669 | | 2/1996 | Smart | 273/72 R |
| 5,620,179 | | 4/1997 | MacKay, Jr. | 473/564 |
| 5,985,197 | * | 11/1999 | Nelson et al. | 264/221 |
| 6,036,610 | | 3/2000 | Lewark | 473/564 |

* cited by examiner

*Primary Examiner*—Mark S. Graham
(74) *Attorney, Agent, or Firm*—David S. Thompson

(57) ABSTRACT

A break resistant ball bat 10 provides an elongated body 20 that generally provides handle and barrel portions 22, 24, with a transition area 26 between them. Upon impact with a ball, vibration having an outer node 30 and an inner node 32 results. The vibration is particularly hazardous for a critical stress area 34, which contains the majority of locations within the bat statistically most likely to break. The critical stress area is roughly coextensive with the handle and a portion of the transition area adjacent to the handle. A fiber sleeve 40 encloses and protects the critical stress area. The fiber sleeve provides a layer of fibers or filaments 42 oriented generally parallel to the length of the bat. The resistance of these filaments to elongation tends to reduce the deflection of the critical stress area upon impact. A matrix 50 of epoxy or resin covers and encloses the filaments. The narrow diameter of individual filaments and their consequently large collective surface area results in a strong bond between the filaments and the matrix.

2 Claims, 2 Drawing Sheets

BREAK RESISTANT BALL BAT

CROSS-REFERENCES

There are no applications related to this application filed in this or any foreign country.

BACKGROUND

The increase in the cost of the high-grade wood used for baseball and softball bats has resulted in an increase in the expense of breaking a ball bat. Also, an increase in the use of lower grade materials has resulted in bats breaking with greater frequency, and a corresponding greater cost.

As a result of the cost of high-grade materials and the quality problems associated with less expensive materials, several alternative baseball bat structures have been developed. A well-known alternative is to use metal in a ball bat's construction. This has several problems, including particularly the increasing costs of such metal bats and the prohibition against such bats by Major League Baseball.

A lesser-known alternative is to use a laminated wood construction. While this construction is advantageous for strength and other reasons, the problem of ball bat breakage has still not been solved.

The failure mode by which baseball bats break is not fully understood. However, it is clear that the point of impact with the ball, typically on the barrel of the bat, is not the likely location of the break. The most common location at which a baseball bat will break is in or near the handle portion, in a location where the bat is relatively small in diameter.

Upon impact with a ball, a baseball bat will vibrate. It is thought that, under typical strenuous conditions, the bat will momentarily assume a shape that is very slightly sinusoidal. Typically, there will be two nodes along the length of the bat, between which the bat will be deformed for a short period to a greater or lesser degree. Many factors may determine the amplitude and frequency of the vibration, including the structure of the bat, the grip strength and location by the player, the point of impact of the ball and the speed and direction of the ball and bat.

If the impact of the ball is sufficiently forceful, and various of the above factors combine unfavorably, the bat will break. Due to a combination of the forces involved and the strength characteristics of most bats, the location of the break is almost invariably at a location between the nodes, in the handle or in the area of transition between the handle and the barrel.

For the foregoing reasons, there is still a need for a baseball bat design that can reduce construction costs and at the same time reduce the frequency of broken bats. The improved bat design must include a reinforcing structure which reduces the incidence of breakage, particularly in the critical stress area where most breakage occurs.

SUMMARY

The present invention is directed to an apparatus that satisfies the above needs. A novel break resistant baseball bat is provided having an improved structure which overcomes the disadvantages of previous designs of baseball bats.

The break resistant baseball bat of the present invention provides some or all of the following structures.

(A) An elongated wood body, typically of conventional wood construction, but alternately of any innovative design, such as laminated wood. The elongated body includes handle, barrel and transition areas. Due to the nature of the collision between a ball and the wood body, a critical stress area contains the majority of locations statistically most likely to break. The critical stress area is roughly coextensive with the handle and a portion of the transition area adjacent to the handle.

(B) A fiber sleeve covers and reinforces the critical stress area in a manner which tends to reduce the incidence of deflection of this portion of the bat upon impact. A preferred sleeve includes many thousands of very slender filaments oriented along the lengthwise direction of the elongated wood body. Due to the lengthwise orientation of the filaments, the bat's deflection upon impact is reduced. The sleeve also includes a small number of typically elastic filaments woven among the lengthwise-oriented filaments for organizing the lengthwise filaments in a manner that prevents bunching and prevents thin spots, and which allows installation of the sleeve on the bat prior to the application of the matrix.

(C) A matrix of epoxy or resin encases the filaments. Due to their large numbers, the filaments collectively define a large surface area. As a result, before the curing of the matrix, the epoxy or resin is "worked into" the fiber sleeve with the result that the matrix has a large surface area of contact with the filaments collectively. In consequence, the bond between the matrix and the fiber sleeve is very strong. Additionally, due to the very small diameter of the individual filaments, and the characteristic that the matrix tends to provide a very thin coating on all sides of each filament, it is the case that the matrix is uniformly thick and homogeneous. In consequence, despite its approximately 1/16" thickness, the matrix is very strong.

It is therefore a primary advantage of providing a novel break resistant baseball bat having a reinforced middle portion that spreads the stress of impact with a baseball over a greater length of the bat, and that reduces the stress in the critical stress area which is most likely to break.

Another advantage of the present invention is to provide a novel sleeve for a ball bat that is substantially oriented in the lengthwise direction, and which is made of a filament having sufficient strength to resist forces tending to deflect the bat and to reduce the stress of vibration thereby protecting the ball bat from breakage.

A still further advantage of the present invention is to provide a novel break resistant baseball bat having a reinforced middle portion that alters the frequency and amplitude of the vibration created by impact with a ball, and thereby minimizes the likelihood of breakage.

DRAWINGS

These and other features, aspects, and advantages of the present invention will become better understood with regard to the following description, appended claims, and accompanying drawings where:

DESCRIPTION

Figure 1:
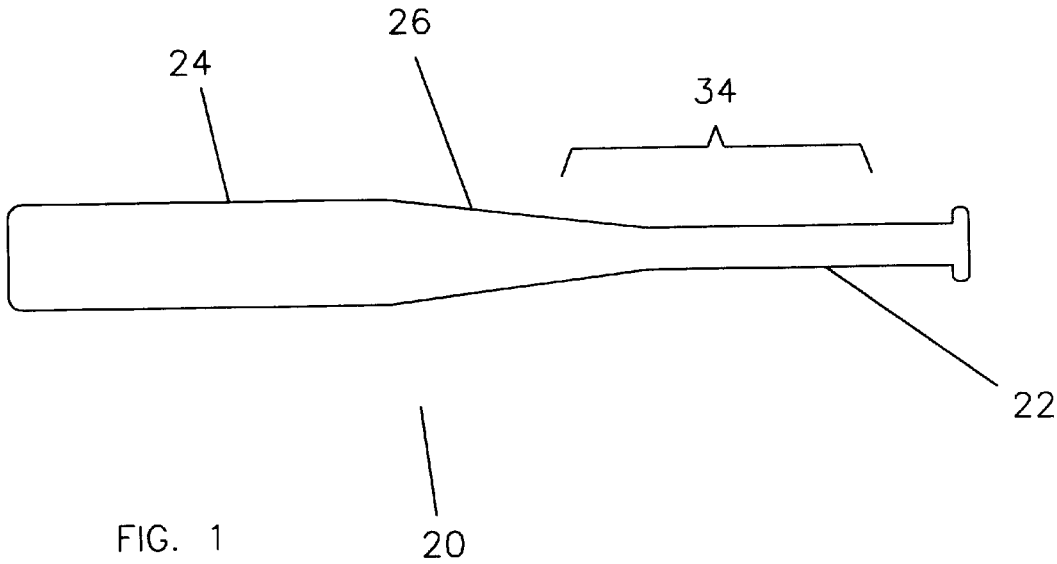
FIG. 1 is an isometric view of a wood baseball bat prior to application of the fiber sleeve.
Figure 2:
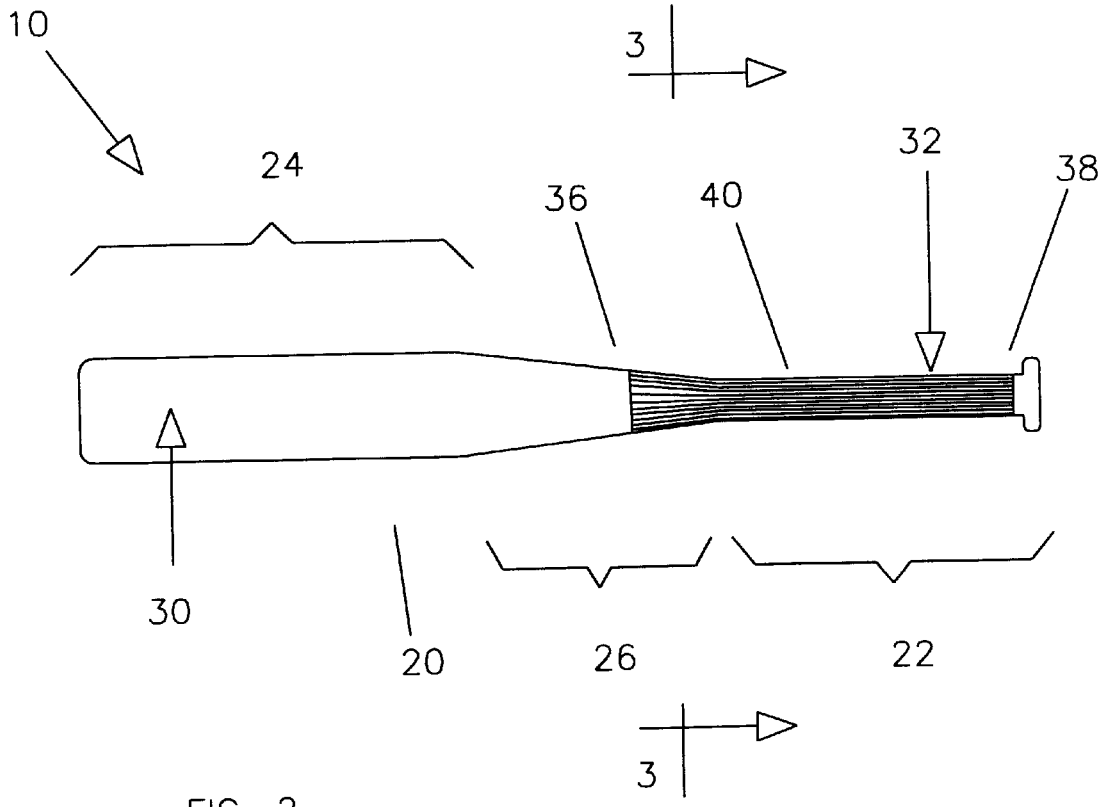
FIG. 2 is a perspective view of the bat of FIG. 1, having a fiber sleeve encasing its critical stress area, in accordance with a version of the invention.
Figure 3:
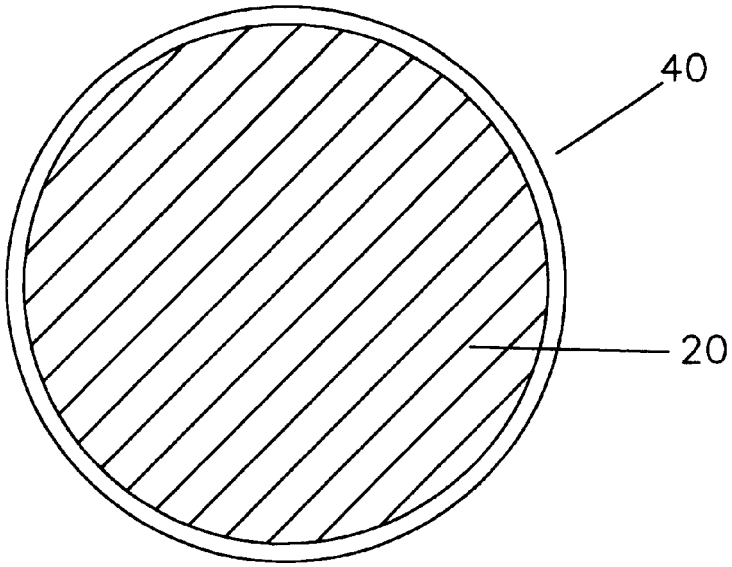
FIG. 3 is a cross-sectional view of the critical stress area of the bat of FIG. 2.

Referring in generally to the figures, a break resistant ball bat 10 constructed in accordance with the principles of the invention is seen. The ball bat provides an elongated body 20 that generally includes handle and barrel portions 22, 24, with a transition area 26 between them. Upon impact with a ball, vibration having an outer node 30 and an inner node 32 results. The vibration is particularly hazardous for a critical stress area 34, which contains the majority of locations within the bat statistically most likely to break. The critical stress area is roughly coextensive with the handle and a portion of the transition area adjacent to the handle. A fiber sleeve 40 encloses and protects the critical stress area. The fiber sleeve provides a thousands of fibers or filaments 42 oriented generally parallel to the length of the bat. The resistance of these filaments to elongation tends to reduce the deflection of the critical stress area upon impact. A matrix 50 of epoxy or resin covers and encloses the filaments. The narrow diameter of individual filaments and their consequently large collective surface area results in a strong bond between the filaments and the matrix.

The fiber sleeve 40 contains thousands of individual fibers or filaments 42, each of which is generally the full length of the sleeve. In a preferred embodiment, the length of the sleeve is approximately 18 inches, and generally extends over and covers the critical stress area 34, between outer limit 36 and an inner limit 38.

Filaments made from number of different materials may be used, including those made from carbon, aramid or e-glass. Depending on the material used to form the filaments, the complete sleeve will weigh approximately 0.5 to 2.2 ounces, although this range is somewhat variable. The aramid filaments, sold under the trademark Kevlar®, provide an excellent ratio of strength to weight.

The filaments 42 within the fiber sleeve 40 are oriented in the lengthwise direction of the direction of the bat. A small number of elastic filaments are woven among the lengthwise-oriented filaments. These elastic filaments organize the lengthwise filaments 42 in a manner that prevents bunching and prevents thin spots. As a result, the fiber sleeve is uniformly thick. Consequently, the critical stress area is covered with a consistent covering of filaments, the vast majority of which are oriented in the lengthwise direction.

Figure 4:
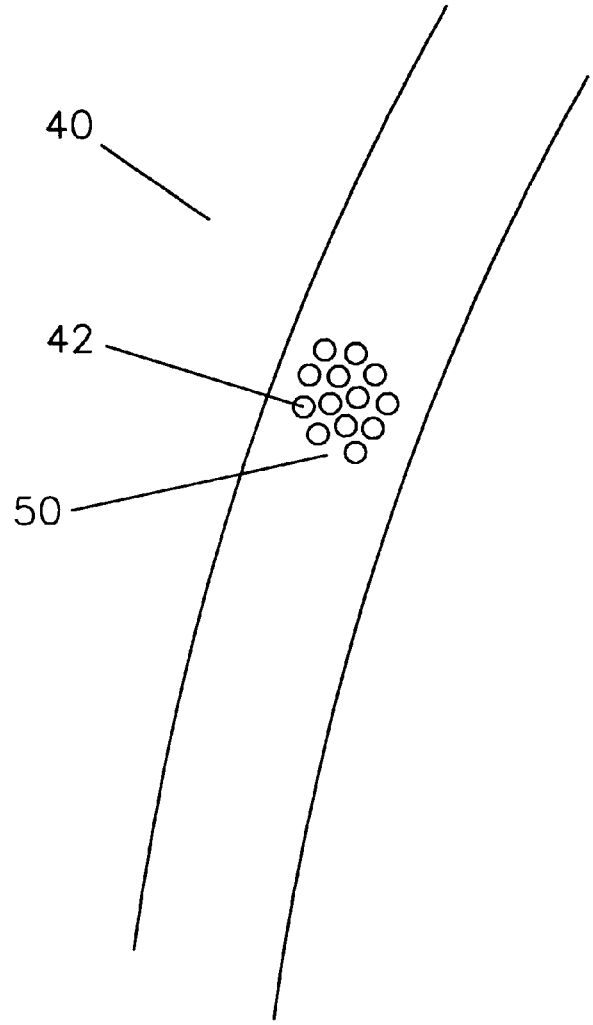
FIG. 4 is a somewhat diagrammatic view, not to scale, of the cross-section of FIG. 2, sufficiently enlarged to reveal individual filaments and the matrix within which they are supported.

As seen in the enlarged view of FIG. 4, the filaments 42 of the fiber sleeve are surrounded or encased by a matrix 50 of resin or epoxy. For example, the matrix may be made of Shell® resins 286, 828 and 862. These resins may be cured with a 3234 or 3274 hardener. This process will result in a 30 or 90 minute pot life, respectively. The Shell® 828 resin adheres well to Ash, and provides a reasonable work time when cured with the 3234 hardener. This system also has a sufficient cure after 12 hours at 70 degrees F. for further processing.

A faster cure epoxy from QCM, in Kent, Wash., (EHV 0050/ECA 312) has an advantageously short 10 minute pot life, but may prove difficult to process.

By way of example, and not as a limitation, three approaches are disclosed for resin application. These include wet lay-up, resin film and pre-impregnation.

In wet lay-up, the dry fiber sleeve 40 is placed over the critical stress area 34. The resin forming the matrix 50 is then painted onto the handle and worked into the sleeve with rollers, spatulas or other tools. This process accommodates a wide range of resins, including most of the fastest curing, but is somewhat messy.

Nevertheless, while wet lay-up is not a clean process, it is generally preferred, since it accommodates low temperature curing also because the tooling requirements are minimal.

Slower curing resins can be supplied on resin sheets. Using this resin delivery mechanism, the quantity of resin can be accurately controlled, thereby reducing waste and mess. However, the viscosity of these systems necessitates higher temperatures to cure and fully wet the fiber sleeve.

Alternatively, the fiber sleeve can be pre-impregnated with resin. This process has advantages and disadvantages that are similar to the use of resin sheets.

After application of the resin, the filaments must be consolidated. That is, the distance between filaments must be minimized to produce a compact layer. Five methods of filament consolidation are disclosed. They include autoclave, tube-clave, shrink tape, release cloth and release film. The first two processes rely on a machine to provide consolidation during the cure. To be practical, this necessitates a fast, high temperature cure. Alternatively, a large number of machines are required.

The last three processes rely on a disposable medium that is wrapped on the fiber sleeve after application of the resin. This generally requires that the bat be mounted lengthwise in a lathe or similar tool and rotated as the disposable medium is applied.

The autoclave is essentially a pressurized oven. This process produces a high quality result. However, the autoclave is expensive, slow and generally not suited for high production applications.

A simplified autoclave known as the tube-clave provides high pressure consolidation of the filaments 42 with high production. However, a low mean time between failures of such tube-clave devices may cause this option to be expensive.

Heat shrink tape is a continuous plastic strip that shrinks when heated. It may be employed to wrap around cylindrical parts to consolidate filaments during cure. During the application of heat, the shrink tape constricts on the filaments, thereby consolidating the filaments within the resin matrix.

A Teflon® coated glass cloth may be used in a method similar to shrink tape. Such a cloth does not shrink, but instead relies on the tension during application. That is, the cloth is stretched tight during application, as the bat is turned on a lathe or similar tool.

Shrink tape and release cloth both may result in some texture problems if applied in a manner inconsistent with the contour of the bat. This may be particularly noticeable near the knob of the handle.

A preferred method of filament consolidation is to wrap release film about the fiber sleeve 40 and matrix 50. The release film is similar to the Teflon® cloth and heat shrink tape. However, release film is thin enough that it generally does not have the texture problems that may be associated with shrink tape and release cloth. As a result, bats wrapped with release film and cured under ambient conditions provide the most uniform surface finish.

As an example, a preferred version of the invention is made by the following sequence of steps. First, a bat is produced and the critical stress area is identified from prior experience with bats of a similar nature.

The dry, precut glass or aramid fiber sleeve 40 is put over the bat. Because the filaments 42 are precut to the desire length, the fiber sleeve covers the critical stress area 34.

The premixed and weighed resin system, such as the Shell® resins and hardeners, is applied to the dry filaments, typically with rollers, brushes or similar tools.

The resin system is then worked into the fiber sleeve, producing a matrix which surrounds each of the thousands of filaments. The resin system typically includes the combination of a resin and an associated hardener. This process is continued until all of the filaments are coated. Uncoated areas generally appear white in color; therefore the resin system is added or worked into all such areas.

The fiber sleeve is then wrapped with release film which is held under tension to result in a radially inward pressure. This results in consolidation of the filaments 42 in a consistent, uniform manner, with the filaments oriented parallel to the length of the bat.

The bat is then cured at low temperatures, typically about 120 degrees F. for 24 hours.

The bat is then placed in a fixture, such as a lathe-type tool, for removal of the release film.

The bat is then finished as usual.

The previously described versions of the present invention have many advantages, including a primary advantage of providing a novel break resistant baseball bat having a sleeve carried about the critical stress area that spreads the stress of impact with a baseball over a greater length of the bat, and that reduces the stress in the critical stress area which is most likely to break.

Another advantage of the present invention is to provide a novel sleeve for a ball bat comprising a plurality of filaments substantially oriented in the lengthwise direction, and which has sufficient strength to resist forces tending to deflect the bat and to reduce the stress of vibration thereby protecting the ball bat from breakage.

A still further advantage of the present invention is to provide a novel break resistant baseball bat having a sleeve carried about the critical stress area that alters the frequency and amplitude of the vibration created by impact with a ball, and thereby minimizes the likelihood of breakage.

Although the present invention has been described in considerable detail and with reference to certain preferred versions, other versions are possible. For example, while a number of specific materials have been disclosed for use in filaments and resins, it is clear that some material substitution could be resorted to, while still in keeping with the teachings of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A break resistant baseball bat comprising:

(A) an elongated wood body;

(B) a fiber sleeve comprising:

(a) a plurality of lengthwise filaments oriented parallel to a lengthwise direction of the elongated wood body, covering a critical stress area;

(b) elastic filaments, woven among the lengthwise filaments, whereby the elastic filaments organize the lengthwise filaments to form a uniformly thick and consistent covering, the elastic filaments preventing bunching, preventing thin spots, and maintaining the lengthwise orientation of the lengthwise filaments; and (c) whereby the vast majority of filaments are oriented in the lengthwise direction; and (C) a matrix encasing the lengthwise filaments and the elastic filaments.

2. The method of making a break resistant baseball bat comprising:

(A) producing a bat and identifying a critical stress area;

(B) putting a sleeve on the bat, the sleeve comprising:

(a) a plurality of lengthwise filaments over the critical stress area, whereby the filaments are oriented in a lengthwise direction;

(b) elastic filaments, woven among the lengthwise filaments, whereby the elastic filaments organize the lengthwise filaments to form a uniformly thick and consistent covering, the elastic filaments preventing bunching, preventing thin spots, and maintaining the lengthwise orientation of the lengthwise filaments; and (c) whereby the vast majority of filaments are oriented in the lengthwise direction;

(C) applying a resin system to the sleeve;

(D) working the resin system into the sleeve, whereby the filaments are coated;

(E) consolidating the filaments by wrapping a release film about the sleeve;

(F) curing the bat at approximately 120 degrees F. for 24 hours; and (G) removing the release film.

* * * * *